US008007302B2

(12) United States Patent
Kleinke

(10) Patent No.: US 8,007,302 B2
(45) Date of Patent: Aug. 30, 2011

(54) PLUG TYPE CONNECTOR

(75) Inventor: Andreas Kleinke, Kierspe (DE)

(73) Assignee: Escha Bauelemente GmbH, Halver (DE)

( * ) Notice: Subject to any disclaimer, the term of this patent is extended or adjusted under 35 U.S.C. 154(b) by 0 days.

(21) Appl. No.: 12/301,267

(22) PCT Filed: May 25, 2007

(86) PCT No.: PCT/EP2007/004685

§ 371 (c)(1),
(2), (4) Date: Nov. 18, 2008

(87) PCT Pub. No.: WO2007/137787

PCT Pub. Date: Dec. 6, 2007

(65) Prior Publication Data

US 2009/0311910 A1 Dec. 17, 2009

(30) Foreign Application Priority Data

May 30, 2006 (DE) ..... 10 2006 025 134

(51) Int. Cl.
*H01R 13/52* (2006.01)

(52) U.S. Cl. ..... 439/275; 439/589

(58) Field of Classification Search ..... 439/271, 439/272, 274, 275, 278, 279, 281, 587–289, 439/604, 606

See application file for complete search history.

(56) References Cited

U.S. PATENT DOCUMENTS

| | | | | | |
|---|---|---|---|---|---|
| 3,816,641 | A * | 6/1974 | Iversen | 174/76 |
| 4,053,201 | A * | 10/1977 | Grappe | 439/589 |
| 4,310,213 | A * | 1/1982 | Fetterolf et al. | 439/320 |
| 4,795,360 | A * | 1/1989 | Newman et al. | 439/278 |
| 5,100,341 | A * | 3/1992 | Czyz et al. | 439/447 |
| 5,567,170 | A * | 10/1996 | Kroeber | 439/186 |
| 5,797,761 | A | 8/1998 | Ring | |
| 6,268,565 | B1 * | 7/2001 | Daoud | 174/657 |
| 6,361,342 | B1 * | 3/2002 | Cox | 439/275 |
| 6,607,403 | B2 | 8/2003 | Tschope et al. | |
| 6,676,447 | B1 * | 1/2004 | Knox | 439/587 |
| 7,575,458 | B2 * | 8/2009 | Parmeter et al. | 439/271 |
| 2002/0076982 | A1 | 6/2002 | Tschope et al. | |

FOREIGN PATENT DOCUMENTS

| | | | |
|---|---|---|---|
| DE | 94 10 092 | U1 | 8/1994 |
| DE | 100 58 265 | C1 | 8/1994 |
| DE | 200 04 565 | U1 | 6/2000 |
| DE | 200 12 284 | U1 | 11/2001 |
| EP | 1 381 114 | A | 1/2004 |
| WO | WO 2005/101582 | A | 10/2005 |

OTHER PUBLICATIONS

International Search Report for PCT/EP2007/004685, dated Aug. 21, 2007.

* cited by examiner

*Primary Examiner* — Thanh-Tam T Le

(74) *Attorney, Agent, or Firm* — Kevin P. Radigan, Esq.; Heslin Rothenberg Farley & Mesiti P.C.

(57) ABSTRACT

The invention relates to a plug-type connector with a cable, which has at least one line, a contact carrier, which has at least one contact element, which is connected to the at least one line of the cable, and an encapsulation, which is injected around the cable and the contact carrier, wherein a sealing element for sealing the encapsulation off from the outer sheath of the cable is provided.

25 Claims, 3 Drawing Sheets

PLUG TYPE CONNECTOR

CROSS REFERENCE TO RELATED APPLICATIONS

This application is a national stage filing under section 371 of International Application No. PCT/EP2007/004685, filed on May 25, 2007, and published in German on Dec. 6, 2007, as WO 2007/137787 A1, and which claims priority of German application No. 10 2006 025 134.2, filed on May 30, 2006, the entire disclosure of these applications being hereby incorporated herein by reference.

TECHNICAL FIELD

The Invention relates to a plug-type connector. In particular, the present invention relates to a plug-type connector for use in a high temperature range.

BACKGROUND OF THE INVENTION

In the context of this patent, "high temperature range" is intended to mean a temperature range in which special materials which withstand the high temperatures have to be used for the plug-type connector and the cable. As a rule, these are temperatures of more than 120° C. The upper temperature limit of plug-type connectors and cables which are used in the high temperature range is as a rule 250° C. It is clear that, depending on materials used for the plug-type connector and the cable, other temperature limits applicable to the special materials define the high temperature range.

It is known that plug-type connectors can be used for room temperature range. By injecting a housing around the contact carrier and the cable, a completely assembled plug-type connector having a certain cable of certain length is produced. On encapsulating the contact element and the cable with a material which can be used at room temperature, a fluid-tight connection between the injection material forming the housing and the outer sheath of the cable or the contact carrier is produced. This is desirable in most applications because, for example, water entering the plug-type connector might cause a fault in the connection.

DE 100 58 265 C1 and DE 200 04 565 U1 disclose plug-type connectors for underground use. The known plug-type connectors have a housing which mechanically holds and seals the contact carrier by means of sealing elements. The housing is sealed from the cable with a shaped part which consists of a permanently elastic casting or injection moulding material made of plastic. For better sealing, a gasket surrounding the cable sheath is enclosed in a section of the shaped part which extends outside the plug sleeve. These known plug-type connectors have the disadvantage that the shaped part is cast or injection moulded only around the gasket. The gasket can therefore acquire an additional sealing effect only if a weld joint is produced between the shaped part and the gasket. When materials which can withstand higher temperatures are used, the desired welding between the shaped part and the gasket is not possible. These known plug-type connectors are therefore not suitable for high-temperature use.

In the high temperature range, it is necessary to use other materials for the encapsulating material, the contact carrier and the outer sheath of the cable, which can withstand the higher temperatures. These materials comprise heat-resistant plastics. In the case of these materials, there is a problem that they are not welded to one another during the encapsulation process, so that the materials do not form a joint with one another or do not adhere to one another, and a fluid-tight joint therefore does not form.

SUMMARY OF THE INVENTION

It is therefore the object of the invention to further develop a plug-type connector according to the precharacterizing clause of Claim 1 in such a way that the plug-type connector can be used for high temperature and is at the same time fluid-tight.

According to one embodiment of the invention, a plug-type connector comprises a cable, which has at least one wire, a contact carrier, which has at least one contact element which is connected to the at least one wire of the cable, an encapsulation, which is injected around the cable and the contact carrier, and a sealing member for sealing the encapsulation from the outer sheath of the cable.

By providing a sealing member, it is possible to use the plug-type connector according to the invention also in the high temperature range. This was not possible to date because a connection and hence seal between the heat-resistant outer sheath of the cable and the encapsulation are not formed on encapsulation. The only plug-type connectors used to date in the high temperature range have therefore been those having a housing which is sealed from the outer sheath of the cable. Use of encapsulations for plug-type connectors for use in the high temperature range has been neither possible nor known to date if a fluid-tight seal is simultaneously required.

The same applies to other encapsulated plug connectors in which the materials of the encapsulation and of the cable sheath cannot form a material bond (crosslinking) in the injection moulding process. With the plug-type connector according to the invention, it is possible to provide such plug-type connectors with a fluid-tight seal between the cable sheath and the encapsulation.

In the case of the plug-tight connector according to the invention, a material connection between the contact carrier and the encapsulation is preferably achieved. This is preferably effected by the use of the same plastics or plastics forming a joint during the injection moulding process in the insertion method or two-component or multi component method. A solid body comprising the contact carrier and the encapsulation, which is tight per se, is preferably produced. The plug-type connector according to the invention therefore needs no housing since the outer contour is formed by the encapsulation. The seal between the solid body and the cable is effected according to the invention with the sealing member, which is preferably arranged outside the solid body and is pressed against the solid body by suitable means. The sealing member surrounding the cable is pressed against the cable and the solid body, with the result that a seal is produced. The plug-type connectors according to the invention can be formed in such a way that they are compatible in particular with round plug-type connectors according to the round plug-type connector standard DIN EN 61076 or according to corresponding round plug-type connector standards of other countries.

According to the invention, the sealing member can be arranged outside the encapsulation. This has the advantage that the sealing member can be pressed against the encapsulation in a simple manner. The sealing member preferably surrounds the cable of the plug-type connector thereby.

According to the invention, the sealing member can be arranged in such a way that it is pressed against the encapsulation. The sealing member surrounds the cable and, by virtue of the pressing, is pressed both against the encapsulation and against the cable, with the result that a good seal is ensured.

Preferably, the plug-type connector is suitable for high temperature applications or is a high-temperature plug-type connector.

According to the invention, the sealing member can be pressed against the encapsulation and the outer sheath of the cable by a cap mounted on the encapsulation. For this purpose, for example, the cap can be mounted on the encapsulation by means of a screw connection, plug connection, press fit, locking connection, snap connection and/or adhesive bond. Other joining methods known to the person skilled in the art are conceivable. Advantageously, the encapsulation may have fastening members for fastening the cap, which fastening means have been concomitantly formed during the injection process for forming the encapsulation.

According to the invention, the encapsulation may have an outer thread formed on its section on the cable side, and the cap can have an internal thread.

According to the invention, it is possible to provide a monitoring device 90 which, in the case of a relative movement between cap and encapsulation, is changed in such a way that it is possible to detect a relative movement which has taken place. This has the advantage that an indication for good sealing of the plug-type connector is provided. Furthermore, manipulations which might endanger the operational safety can be ruled out. The monitoring device may preferably comprise a protective sticker 91 or a protective seal, which sticker 91 or which seal is torn or destroyed, respectively, in the event of relative movement between cap and encapsulation.

According to the invention, the sealing member may be a gasket and/or a sealing washer.

According to the invention, the sealing member may be formed from heat-resistant plastic. For example, the sealing member may be formed from a fluorocarbon plastic, a fluorine plastic or a plastic having a high proportion of fluorine. In particular, the sealing member may be formed from nitrile-butadiene rubber, hydrogenated nitrile rubber (HNBR), ethylene-propylene-diene rubber (EPDM), ethylene-propylene terpolymer rubber, APTK, PTFE, EFTE, MVQ, VMQ, silicone rubber, fluorosilicone rubber, fluorocarbon rubber, fluorosilicone, fluorine rubber, acrylate rubber, perfluororubber, perfluorinated rubber, polychloroprene rubber, chlorine rubber, chlorosulphonyl-polyethylene rubber, polyester-urethane rubber, polyether-urethane rubber, butyl rubber, FEP, PFA, PVDF or a combination of at least two of these materials.

According to the invention, the contact carrier, the encapsulation and/or the cap can be formed from heat-resistant plastic. Preferably, the contact carrier, the encapsulation and/or the cap can be formed from fluorocarbon plastic, fluorine plastic or a plastic having a high proportion of fluorine. Preferably, the contact carrier, the encapsulation and/or the cap are each formed from polytetrafluoroethane (PTFE or Teflon), EFTE, PPS, PEEK, PPE, PSU, PES, PEI, LCP, ECTFE, PCTFE, PAI, PPO or a combination of at least two of these materials.

According to the invention, at least two of the contact carrier, the encapsulation and the cap can each be formed from the same material. According to the invention, at least two of the contact carrier, the encapsulation and the cap can be formed from different materials.

According to the invention, the outer sheath of the cable can be formed from a heat-resistant plastic, preferably Teflon.

According to the invention, a number of contact elements which corresponds to the number of conductors of the cable can be provided in the contact carrier.

According to the invention, the plug-type connector may be a plug part and the contact elements may be formed in such a way that a contact having a corresponding mating contact element can be formed on their outer surface.

According to the invention, the plug-type connector may also be a counter-plug part, and the contact elements may be formed in such a way that a contact on their inner surface can be formed with a corresponding mating contact element.

Alternatively, the contact elements may also be hermaphrodite contact elements.

According to the invention, a connecting part for connecting the plug connector part to a connector counter part may be provided. The connecting part may be a screw having an outer thread for connection to a counter-connecting part (nut) having an inner thread. Alternatively, the connecting part may be a nut having an inner thread for connection to a counter-connecting part (screw) having an outer thread. The connecting part, preferably in a sliding ring, may be rotatably mounted on the contact carrier.

According to the invention, a seal for sealing the contact carrier from the connecting part can be provided, the seal preferably being an O-ring.

BRIEF DESCRIPTION OF THE DRAWINGS

The invention is described in more detail below with reference to the working examples shown in the figures.

Figure 3:
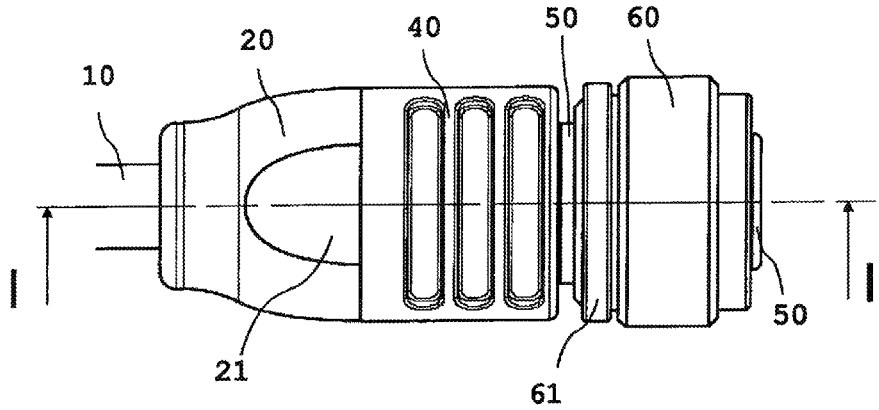
FIG. 3 shows a side view of the plug-type connector of FIG. 1.

The following reference numerals are used in the description of the working examples:

10 cable
11 wire
12 connecting element
13 contact element (female)
14 bush
15 contact element (male)
16 pin
20 cap
21 flat section
22 section on cable side (cap)
23 step
24 sealing member receptacle
25 inner thread
30 sealing member (in particular gasket)
31 internal diameter (sealing member)
32 external diameter (sealing member)
33 sealing washer
40 encapsulation
41 section on cable side (encapsulation)
42 outer thread
43 main section
44 projection

50 contact carrier
51 groove
52 receptacle
53 code recess
60 connecting part (nut)
61 sliding ring
62 sealing member (O-ring)
70 contact carrier
71 groove
72 pin
73 code web
80 connecting part (screw)
81 sliding ring

DETAILED DESCRIPTION OF THE INVENTION

Figure 1:
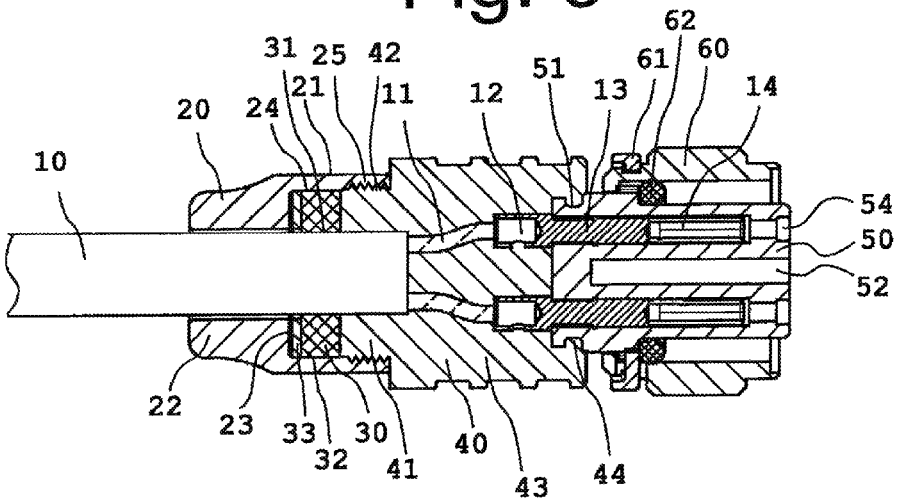
FIG. 1 shows a partly cut away cross-sectional view of a plug-type connector (counter-plug part) having a cable according to an embodiment of the invention, along the line I-I of FIG. 3.
Figure 5:
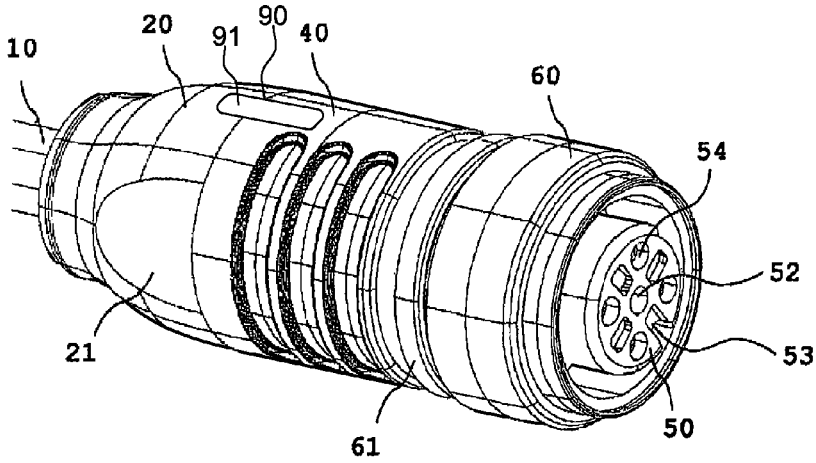
FIG. 5 shows a perspective view of the plug-type connector of FIG. 1.

FIGS. 1, 3 and 5 show a plug-type connector according to a first embodiment of the invention. FIG. 1 shows a cross-sectional view along the line I-I of FIG. 3. FIG. 3 shows a side view and FIG. 5 a cross-sectional view.

The plug-type connector shown in FIGS. 1, 3 and 5 (counter-plug part) is preassembled with the cable 10 of a certain length. The cable 10 is formed from heat-resistant material, its outer sheath being formed from a heat-resistant plastic, preferably from Teflon. The cable 10 is provided with two wires 11 which are connected to a contact element 13 (female) by means of in each case a connecting element 12 in a known manner. The connection can be made in any desired manner known to the person skilled in the art, which is suitable for high-temperature plug-type connectors.

In each case a bush 14 for holding a corresponding contact element 15 of a plug part is provided on the contact elements 13.

The contact elements 13 are held in a contact carrier 50 which has in the middle a receptacle 52 and a code recess. At its end on the cable side, the contact carrier has a groove 51 for securing an encapsulation 40 by means of an interlocking connection.

The completely assembled plug-type connector has an encapsulation 40 which is injected directly onto the cable 10 and the wires 11 with the connected contact carrier in a known manner. On its section 41 on the cable side, the encapsulation has an outer thread 42 onto which a cap 20 is screwed. Furthermore, the encapsulation 40 has a main section 43. At its end on the contact carrier side, the encapsulation 40 has an all-round projection 44 by means of which the encapsulation is secured to the contact carrier 50 by means of an interlocking connection.

The cap 20 is screwed onto that end of the encapsulation which is on the cable side. Said cap has two flat sections 21 which make it easier to screw on the cap. That section 22 of the cap which is on the cable side has an internal diameter which is slightly larger than the external diameter of the outer sheath of the cable 10. This facilitates assembly and moreover permits use for different external diameters of cables, i.e. there is no need to provide a plurality of tools for producing caps for different cables.

The cap 20 is provided with a step 23 at which the internal diameter widens into the sealing member receptacle 24. The sealing member 30 which comprises a gasket is arranged in the sealing member receptacle. The internal diameter 31 of the gasket corresponds to the external diameter of the outer sheath of the cable 10, and the external diameter 32 of the gasket corresponds to the internal diameter of the sealing member receptacle 24. A sealing washer 33 is provided between the step 23 and the gasket. The cap is provided with an internal thread 25 by means of which the cap 20 is screwed onto the outer thread 42 of the encapsulation and clamps the gasket and the sealing washer. This creates a fluid-tight seal between the encapsulation 40 and the cable 10.

The plug-type connector has a connector part 60 (nut) which is secured in a known manner with a sliding ring 61 on the contact carrier. For sealing, a sealing member 62 (O-ring) is provided in the nut.

The plug-type connector is produced from materials which permit use in the high temperature range.

The outer sheath of the cable 10 is formed from a heat-resistant plastic, preferably Teflon. Other materials known to the person skilled in the art are conceivable and are designed, with respect to the outer sheath of the cable, for use in the high temperature range.

The sealing member 30 or the sealing washer 33 and/or the sealing ring or sealing rings 61, 81 are formed from heat-resistant plastic. Preferably, the sealing member 30 or the sealing washer 33 and/or the sliding ring or sliding rings 61, 81 are formed from fluorocarbon plastic, fluorine plastic or a plastic having a high proportion of fluorine. The sealing member 30 or the sealing washer 33 and/or the sliding ring or sliding rings 61, 81 may be formed, for example, from nitrile-butadiene rubber, hydrogenated nitrile rubber (HNBR), ethylene-propylene-diene rubber (EPDM), ethylene-propylene terpolymer rubber, APTK, PTFE, EFTE, MVQ, VMQ, silicone rubber, fluorosilicone rubber, fluorocarbon rubber, fluorosilicone, fluorine rubber, acrylate rubber, perfluororubber, perfluorinated rubber, polychloroprene rubber, chlorine rubber, chlorosulphonyl-polyethylene rubber, polyester-urethane rubber, polyether-urethane rubber, butyl rubber, FEP, PFA, PVDF, from metal, preferably from copper or a copper alloy or a combination of at least two of these materials. Other materials known to the person skilled in the art are conceivable and are designed, with respect to sealing members and sliding rings, for use in the high temperature range.

The contact carrier 50, the encapsulation 40 and/or the cap 20 are formed from heat-resistant plastic. The contact carrier 50, the encapsulation 40 and/or the cap 20 can be formed from fluorocarbon plastic, fluorine plastic or a plastic having a high proportion of fluorine. In particular, the contact carrier 50, the encapsulation 40 and/or the cap 20 may each be formed from polytetrafluoroethane (PTFE or Teflon), EFTE, PPS, PEEK, PPE, PSU, PES, PEI, LCP, ECTFE, PAI, PPO or a combination of at least two of these materials.

It is conceivable that at least two parts (contact carrier 50, encapsulation 40 and cap 20) are each formed from the same material. However, it is also possible for at least two parts (contact carrier 50, encapsulation 40 and cap 20) to be formed from different materials.

In choosing the materials, it is necessary to bear in mind that the materials of encapsulation 40 and contact carrier 50 should be chosen so that, during the injection process, the contact carrier is at least softened so that fusion or welding of encapsulation and contact carrier takes place during the injection process.

Figure 4:
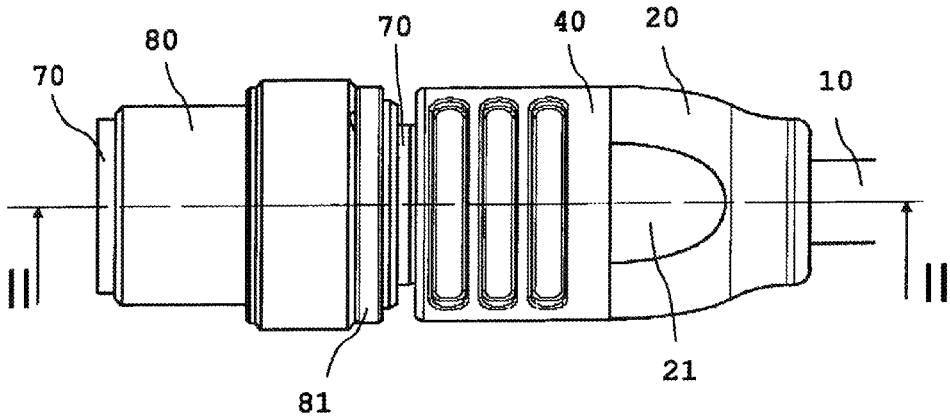
FIG. 4 shows a side view of the plug-type connector of FIG. 2.
Figure 2:
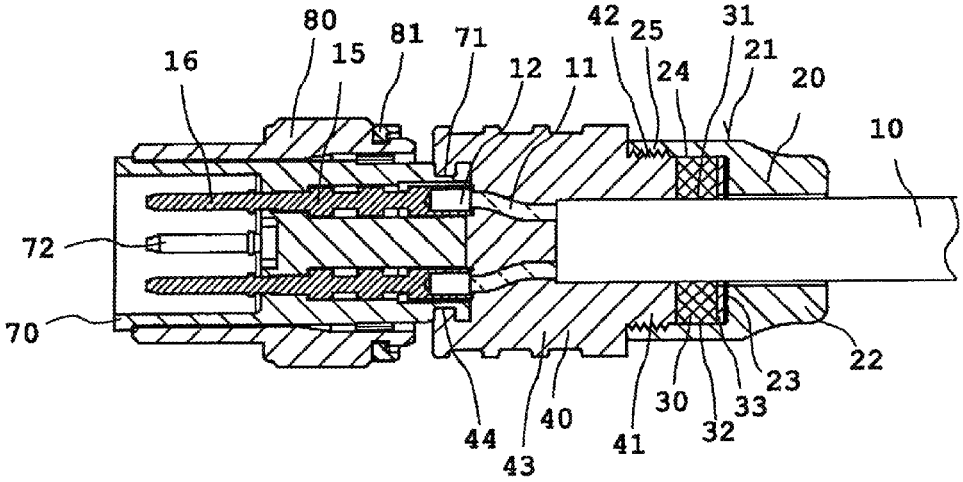
FIG. 2 shows a partly cut away cross-sectional view of a plug-type connector (plug part) having a cable according to a further embodiment of the invention, along the line II-II of FIG. 4.
Figure 6:
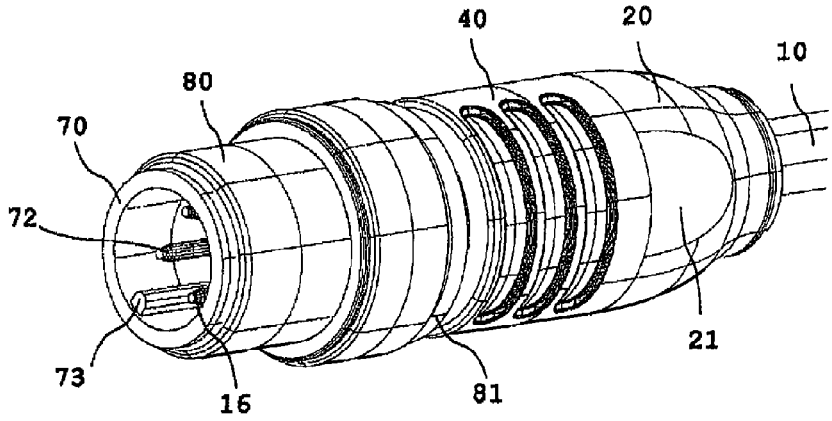
FIG. 6 shows a perspective view of the plug-type connector of FIG. 2.

FIGS. 2, 4 and 6 show a plug-type connector according to a further embodiment of the invention. FIG. 2 shows a cross-sectional view along the line II-II of FIG. 4. FIG. 4 shows a side view and FIG. 6 a cross-sectional view.

The plug-type connector shown in FIGS. 2, 4 and 6 (plug part) is preassembled with a cable 10 of a certain length and can be connected to the counter-plug part shown in FIGS. 1, 3 and 5 and described. Identical parts are provided with identical reference numerals. Below, only the differences will be described. Otherwise, reference is made to the description of the counter-plug part described above in relation to FIGS. 1, 3 and 5.

The contact elements 15 (male) have in each case a pin 16 which is brought into contact with a corresponding bush 14 of the counter-plug part on connection of plug part and counter-plug part.

The contact carrier 70 has a groove 71 which is engaged in an interlocking manner by the projection 44 of the encapsulation 40. The contact carrier 70 is provided with a central pin 72 which is held in the receptacle 52 on connection of plug part and counter-plug part. The code web 73 cooperates with the code recess in order to ensure the correct relative orientation of plug part and counter-plug part.

The plug-type connector has a connecting part 80 (screw) which is secured to the contact carrier 70 by means of a sliding ring 81 in a known manner.

It is clear that alternatives obvious to the person skilled in the art on studying the documents and equivalent solutions should also be within the scope of protection of the present application.

What is claimed is:

1. Plug-type connector comprising a cable, which has at least one wire and an outer sheath, a contact carrier, which has at least one contact element which is connected to the at least one wire of the cable, an encapsulation which is formed around a portion of the cable and the contact carrier, and a sealing member abutting the encapsulation and forming a fluid-tight seal between the encapsulation and the outer sheath of the cable, the sealing member being disposed outside the encapsulation, wherein the sealing member is pressed against the encapsulation and the outer sheath of the cable by means of a cap secured to the encapsulation, and wherein the encapsulation has fastening means being formed concomitantly in an injection process for the formation of the encapsulation, said fastening means being adapted to fasten the cap, in which the encapsulation has an outer thread, said outer thread being formed on a cable side of the encapsulation and the cap having an inner thread.

2. Plug-type connector according to claim 1, wherein the plug-type connector is suitable for high-temperature applications or is a high-temperature plug-type connector.

3. Plug-type connector according to claim 1, in which the cap is secured to the encapsulation by means of a screw connection, plug connection, press fit, locking connection, snap connection or adhesive bond.

4. Plug-type connector according to claim 1, in which a monitoring device is provided which, in the event of a relative movement between the cap and the encapsulation, is changed in such a way that the relative movement which has taken place is detectable.

5. Plug-type connector according to claim 1, in which the sealing member is a gasket or a sealing washer made from heat-resistant plastic.

6. Plug-type connector according to claim 1, further comprising at least one sliding ring being formed from heat-resistant plastic.

7. Plug-type connector according to claim 6, in which the sealing member or the at least one sliding ring is formed from fluorocarbon plastic, fluorine plastic or a plastic having a high proportion of fluorine.

8. Plug-type connector according to claim 6, in which the sealing member or the at least one sliding ring is formed from nitrile-butadiene rubber, hydrogenated nitrile rubber (HNBR), ethylene-propylene-diene rubber (EPDM), ethylene-propylene terpolymer rubber, APTK, PTFE, EFTE, MVQ, VMQ, silicone rubber, fluorosilicone rubber, fluorocarbon rubber, fluorosilicone, fluorine rubber, acrylate rubber, perfluororubber, perfluorinated rubber, polychloroprene rubber, chlorine rubber, chlorosulphonyl-polyethylene rubber, polyester-urethane rubber, polyether-urethane rubber, butyl rubber, FEP, PFA, PVDF or from metal, preferably from copper or from a copper alloy or a combination of at least two of these materials.

9. Plug-type connector according to claim 1, in which the contact carrier, the encapsulation or the cap are formed from heat-resistant plastic.

10. Plug-type connector according to claim 9, in which the contact carrier, the encapsulation or the cap are formed from fluorocarbon plastic, fluorine plastic or a plastic having a high proportion of fluorine.

11. Plug-type connector according to claim 9, in which the contact carrier, the encapsulation or the cap are each formed from polytetrafluoroethane (PTFE or Teflon), EFTE, PPS, PEEK, PPE, PSU, PES, PEI, LCP, ECTFE, PCTFE, PAI, PPO or a combination of at least two of these materials.

12. Plug-type connector according to claim 1, in which at least two of the contact carrier, the encapsulation and the cap are each formed from the same material.

13. Plug-type connector according to claim 1, in which at least two of the contact carrier, the encapsulation and the cap are formed from different materials.

14. Plug-type connector according to claim 1, in which the outer sheath of the cable is formed from a heat-resistant plastic, preferably Teflon.

15. Plug-type connector according to claim 1, in which a number of contact elements which corresponds to a number of conductors of the cable is provided in the contact carrier.

16. Plug-type connector according to claim 1, in which the plug-type connector is a plug part, and the contact elements are formed in such a way that a contact with a corresponding mating contact element can be formed on their outer surface.

17. Plug-type connector according to claim 1, in which the plug-type connector is a counter-plug part and the at least one contact element is formed in such a way that a contact on an inner surface of the at least one contact element can be formed with a corresponding mating contact element.

18. Plug-type connector according to claim 1, in which the at least one contact element is hermaphroditic.

19. Plug-type connector according to claim 1, in which the plug-type connector comprises a connecting part provided for connecting the plug-type connector to a counter-plug connector.

20. Plug-type connector according to claim 19, in which the connecting part is a screw having an outer thread for connection to a counter-connecting part (nut) having an inner thread.

21. Plug-type connector according to claim 19, in which the connecting part is a nut having an inner thread for connection to a counter-connecting part (screw) of the counter-plug connector, the counter-connecting part having an outer thread with which the inner thread of the connecting part engages to connect the plug-type connector to the counter-plug connector.

22. Plug connector part according claim 19, in which the connecting part, preferably in a sliding ring, is rotatably mounted on the contact carrier.

23. Plug-type connector according to claim 19, in which a seal for sealing the contact carrier from the connecting part is provided, the seal preferably being an O-ring.

24. Plug-type connector according to claim 1, wherein the encapsulation forms an outer contour of the plug-type connector, and wherein the encapsulation is provided absent a housing surrounding the totality of the encapsulation.

25. Plug-type connector comprising a cable, which has at least one wire and an outer sheath, a contact carrier, which has at least one contact element which is connected to the at least one wire of the cable, an encapsulation which is formed around a portion of the cable and the contact carrier, and a sealing member abutting the encapsulation and forming a fluid-tight seal between the encapsulation and the outer sheath of the cable, the sealing member being disposed outside the encapsulation, in which the sealing member is pressed against the encapsulation and the outer sheath of the cable by means of a cap secured to the encapsulation, in which a monitoring device is provided which, in the event of a relative movement between the cap and the encapsulation, is changed in such a way that a relative movement which has taken place is detectable, and in which the monitoring device comprises a protective sticker or a protective seal, which the protective sticker or which the protective seal is torn or destroyed, respectively, in the event of a relative movement between the cap and the encapsulation.

* * * * *